US011788328B1

(12) United States Patent
Helms

(10) Patent No.: US 11,788,328 B1
(45) Date of Patent: Oct. 17, 2023

(54) HINGE STOP ASSEMBLY

(71) Applicant: Tracey Helms, Hartford, WI (US)

(72) Inventor: Tracey Helms, Hartford, WI (US)

( * ) Notice: Subject to any disclaimer, the term of this patent is extended or adjusted under 35 U.S.C. 154(b) by 0 days.

(21) Appl. No.: 17/752,382

(22) Filed: May 24, 2022

(51) Int. Cl.

| | |
|---|---|
| ***E05F 5/02*** | (2006.01) |
| ***E05C 17/54*** | (2006.01) |
| ***E05C 17/00*** | (2006.01) |
| ***E05D 11/00*** | (2006.01) |

(52) U.S. Cl.
CPC ..... *E05C 17/54* (2013.01); *E05C 17/025* (2013.01); *E05D 11/00* (2013.01); *E05Y 2201/224* (2013.01); *E05Y 2900/132* (2013.01)

(58) Field of Classification Search
CPC ..... E05D 11/00; E05D 11/06; E05D 11/10; E05D 11/1007; E05D 11/1028; E05D 11/1014; E05D 11/0054; E05D 2011/10; E05D 2011/1028; E05D 2011/1092; E05Y 2201/28; E05Y 2201/224; E05Y 2900/132; E05F 5/06; E05C 17/00; E05C 17/025; E05C 17/54; Y10T 16/61; Y10T 16/551
See application file for complete search history.

(56) References Cited

U.S. PATENT DOCUMENTS

| | | | | |
|---|---|---|---|---|
| D286,015 | S * | 10/1986 | Johnson | D8/402 |
| 5,027,471 | A * | 7/1991 | Barnes | E05F 5/06 292/288 |
| 5,044,681 | A * | 9/1991 | Neighbors | E05C 17/025 292/288 |
| 5,450,652 | A * | 9/1995 | Webb | E05C 17/025 16/82 |
| 5,509,235 | A * | 4/1996 | Chander | E05D 11/1014 160/40 |
| 5,511,837 | A * | 4/1996 | Dempsey | E05C 17/025 292/288 |
| 5,711,557 | A | 1/1998 | Nicolosi | |
| D538,149 | S | 3/2007 | Yarde | |
| 7,559,114 | B2 | 7/2009 | Ranilovich | |
| 7,904,992 | B2 | 3/2011 | Agster | |
| 8,678,453 | B2 * | 3/2014 | Caliguri | E05C 17/025 292/288 |
| 8,955,891 | B2 | 2/2015 | Mlllsap | |
| 9,127,489 | B2 * | 9/2015 | Orlov | E05C 17/54 |
| 10,801,238 | B1 | 10/2020 | Cox | |
| 11,118,382 | B2 * | 9/2021 | File | E05C 17/025 |

(Continued)

FOREIGN PATENT DOCUMENTS

| | | | |
|---|---|---|---|
| GB | 2382105 A * | 5/2003 | E05C 17/025 |
| JP | 4383645 B2 * | 12/2009 | |

(Continued)

*Primary Examiner* — Chuck Y Mah

(57) ABSTRACT

A hinge stop assembly for holding a door open includes a stop that comprises a pair of wings oriented at an angle with each other to abut a respective half of a door hinge. In this way the door hinge can be retained in an opened position. A pair of grips is provided and each of the grips is coupled to and extends away from the stop. Each of the grips can engage a respective half of the door hinge for retaining the stop on the door hinge. A pair of pads is provided and each of the pads is coupled to a respective one of the wings to abut a respective half of the door hinge when the stop is positioned on the door hinge.

6 Claims, 4 Drawing Sheets

(56) References Cited

U.S. PATENT DOCUMENTS

| | | | | |
|---|---|---|---|---|
| 2005/0050681 | A1* | 3/2005 | Schlitter | E05F 5/06 16/82 |
| 2008/0079270 | A1* | 4/2008 | Carlson | E05C 17/025 292/343 |
| 2009/0260182 | A1* | 10/2009 | Hall | E05C 17/025 16/82 |
| 2010/0038921 | A1 | 2/2010 | Kirkham | |
| 2011/0214355 | A1* | 9/2011 | Kim | E05D 11/0054 16/223 |
| 2013/0118087 | A1* | 5/2013 | Belyea | E06B 7/362 49/506 |
| 2014/0183883 | A1* | 7/2014 | Millsap | E05C 17/54 292/288 |
| 2016/0145914 | A1 | 5/2016 | Fuentes | |
| 2022/0145681 | A1* | 5/2022 | Hageman | E05D 11/0054 |

FOREIGN PATENT DOCUMENTS

| | | | | |
|---|---|---|---|---|
| WO | WO-9523905 | A1 * | 9/1995 | E05C 17/025 |
| WO | WO-2010127468 | A1 * | 11/2010 | E05C 17/025 |

* cited by examiner

HINGE STOP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to stop devices and more particularly pertains to a new stop device for holding a door open. The device includes a stop that includes a pair of wings and a pair of grips that extend away from a respective one of the wings. The stop is positioned against a door hinge such that each of the wings abuts a respective half of the door hinge to retain the hinge in an open position. In this way a door on which the door hinge is positioned can be held open. A pair of grips is disposed on the stop which engages the door hinge for retaining the stop on the door hinge.

(2) Description of Related Art Including Information Disclosed Under 37 CFR 1.97 and 1.98

The prior art relates to stop devices including a door stop which comprises a rod with a series of bends such that the rod can be positioned on a door hinge for retaining the door hinge in an open position. The prior art discloses a door stop which comprises a wedge shaped block that is positionable on a door hinge to inhibit the door hinge from closing. The prior art discloses a variety of door stop devices that comprise a receiver that can engage a pin of a door hinge and a pair of arms that engage respective halves of the door hinge to retain the door hinge in an open position. The prior art discloses a hinge block device that magnetically engages a door hinge to inhibit the door hinge from closing.

BRIEF SUMMARY OF THE INVENTION

An embodiment of the disclosure meets the needs presented above by generally comprising a stop that comprises a pair of wings oriented at an angle with each other to abut a respective half of a door hinge. In this way the door hinge can be retained in an opened position. A pair of grips is provided and each of the grips is coupled to and extends away from the stop. Each of the grips can engage a respective half of the door hinge for retaining the stop on the door hinge. A pair of pads is provided and each of the pads is coupled to a respective one of the wings to abut a respective half of the door hinge when the stop is positioned on the door hinge.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
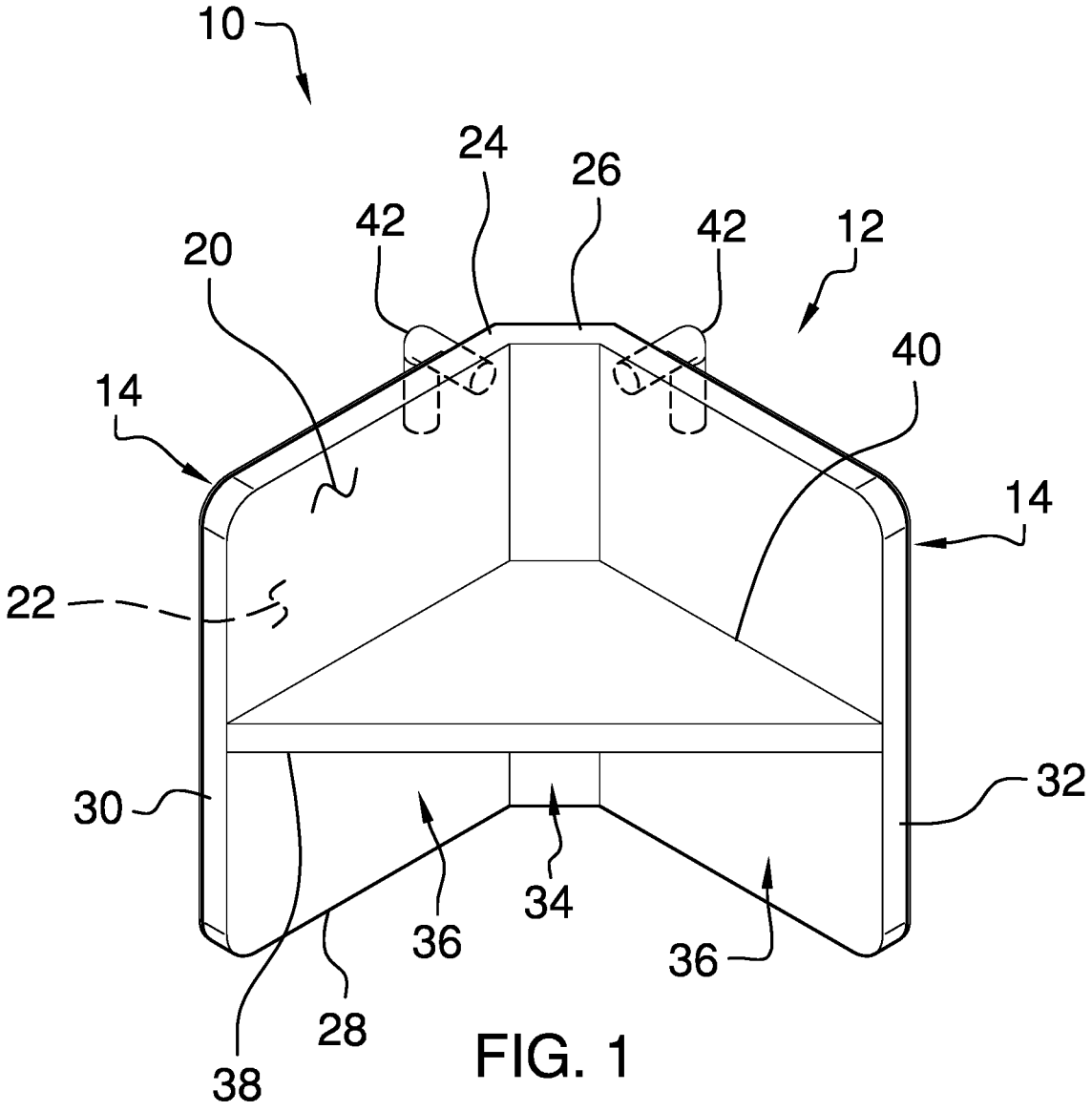
FIG. 1 is a front perspective view of a hinge stop assembly according to an embodiment of the disclosure.
Figure 2:
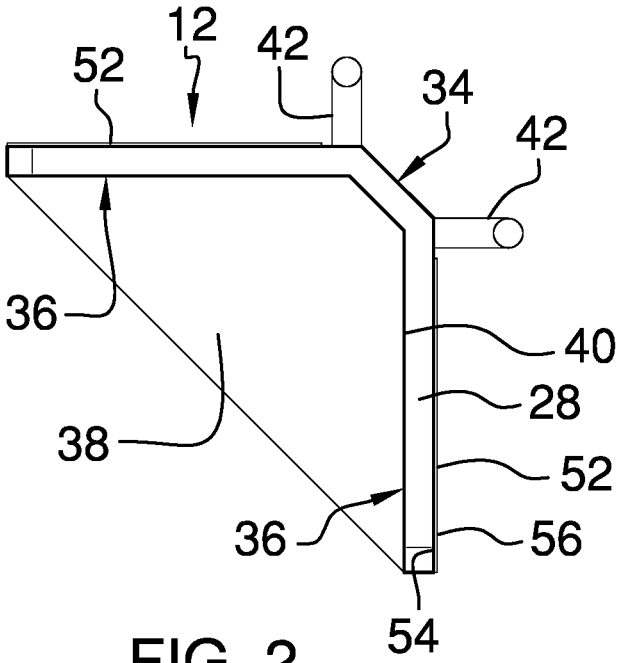
FIG. 2 is a bottom view of an embodiment of the disclosure.
Figure 3:
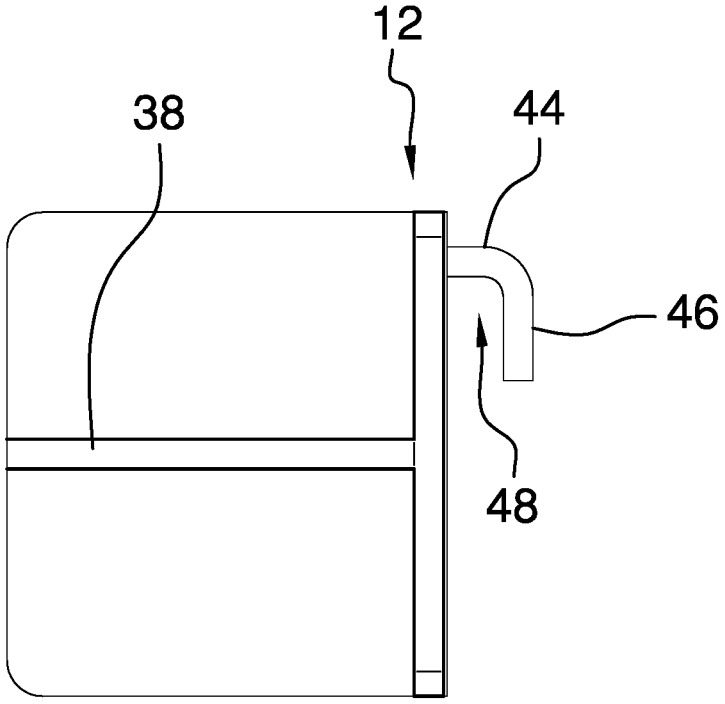
FIG. 3 is a left side view of an embodiment of the disclosure.
Figure 4:
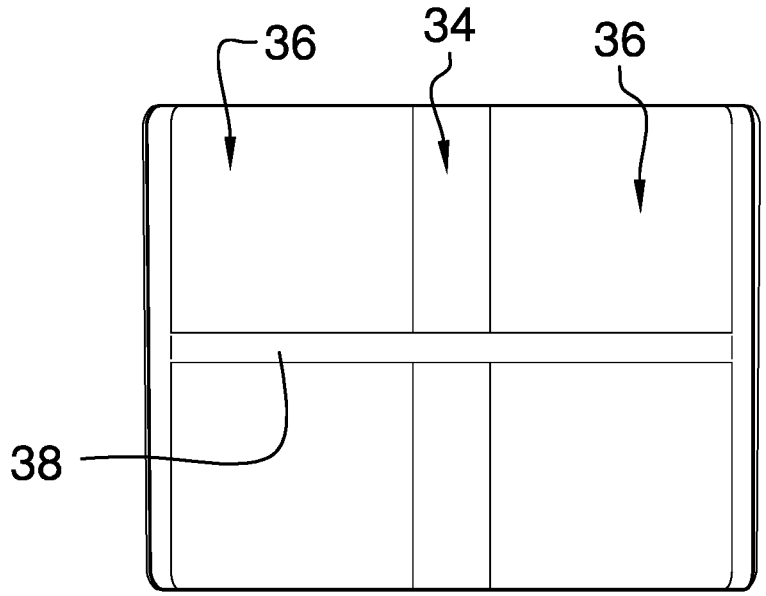
FIG. 4 is a front view of an embodiment of the disclosure.
Figure 5:
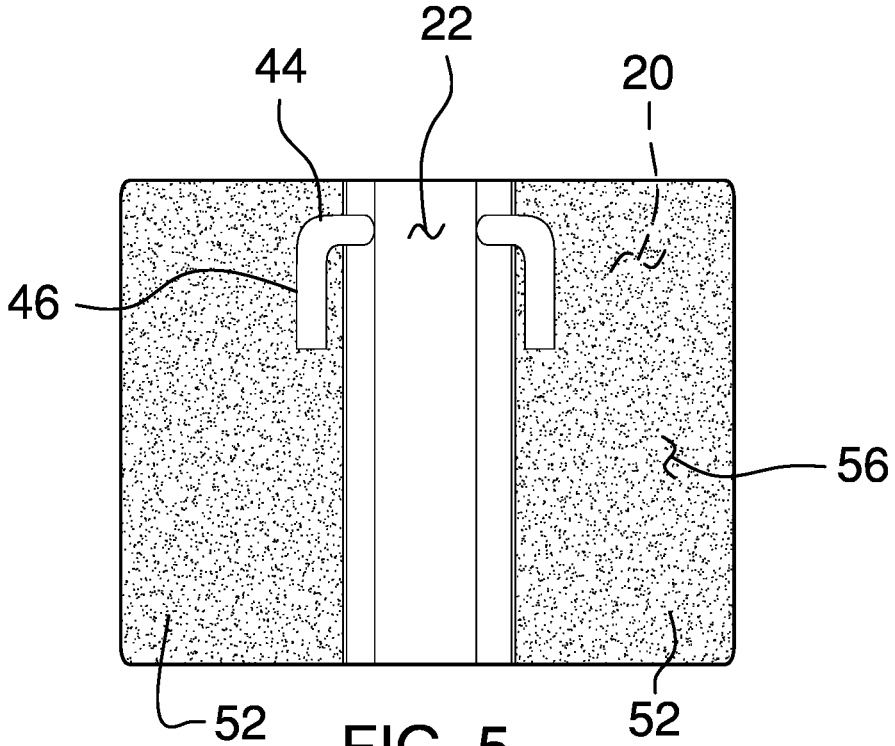
FIG. 5 is a back view of an embodiment of the disclosure.
Figure 6:
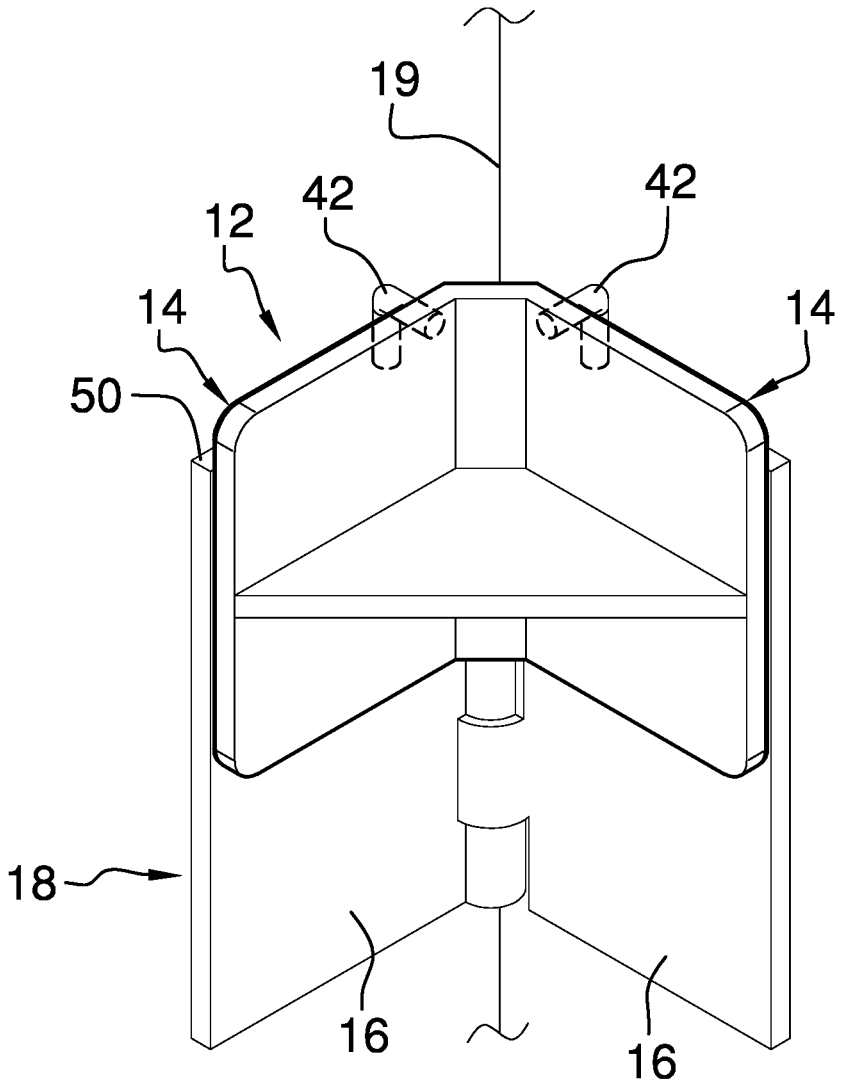
FIG. 6 is a perspective in-use view of an embodiment of the disclosure.

With reference now to the drawings, and in particular to FIGS. 1 through 6 thereof, a new stop device embodying the principles and concepts of an embodiment of the disclosure and generally designated by the reference numeral 10 will be described.

As best illustrated in FIGS. 1 through 6, the hinge stop assembly 10 generally comprises a stop 12 which comprises a pair of wings 14 oriented at an angle with each other. In this way each of the wings 14 can abut a respective half 16 of a door hinge 18 for retaining the door hinge 18 in an opened position. The door hinge 18 may be a hinge on a door 19 of a building, such as an interior door or an exterior door. The stop 12 has a first surface 20, a second surface 22 and a perimeter edge 24 extending between the first surface 20 and the second surface 22, and the perimeter edge 24 has a top side 26, a bottom side 28, a first lateral side 30 and a second lateral side 32.

The stop 12 has a central portion 34 extending between a pair of outward portions 36. The first surface 20 corresponding to each of the outward portions 36 is oriented to lie on a plane that forms an obtuse angle with respect to the first surface 20 corresponding to the central portion 34. In this way each of the outward portions 36 defines a respective one of the wings 14. The obtuse angle formed between the outward portions 36 and the central portion 34 is equivalent with each other such that the first surface 20 corresponding to each of the outward portions 36 forms a right angle with respect to each other. In this way the second surface 22 corresponding to each of the outward portions 36 can abut a respective half 16 of the door hinge 18 for retaining the door hinge 18 in the open position.

A gusset 38 is included which has a first edge 40 that is coupled to the first surface 20 of the stop 12. The gusset 38 extends along each of the outward portions 36 and the central portion 34 of the stop 12. Additionally, the gusset 38 is centrally positioned between the top side 26 and the bottom side 28 of the perimeter edge 24 of the stop 12. Furthermore, the gusset 38 extends between the first lateral side 30 and the second lateral side 32 of the perimeter edge 24 of the stop 12. The gusset 38 enhances rigidity of the stop 12 to inhibit the outward portions 36 from being deflected toward each other. In this way the gusset 38 ensures that the weight of the door that is attached to the door hinge 18 does not collapse the stop 12 when the stop 12 is positioned on the door hinge 18.

A pair of grips 42 is each coupled to and extends away from the stop 12 to engage a respective half 16 of the door hinge 18 for retaining the stop 12 on the door hinge 18. Each of the grips 42 comprises a leg 44 and a foot 46, and the leg 44 of each of the grips 42 extends away from the second surface 22 corresponding to a respective one of the outward portions 36 of the stop 12. The leg 44 of each of the grips 42 is positioned adjacent to the top side 26 of the perimeter edge 24 of the stop 12. Additionally, the leg 44 of each of the grips 42 is positioned adjacent to the central portion 34 of the stop 12. The foot 46 of each of the grips 42 is spaced from and extends downwardly along the second surface 22 corresponding to the respective outward portion. Thus, a hinge space 48 is defined between the foot 46 of each of grips 42 and the second surface 22 corresponding to the respective outward portion. Furthermore, the hinge space 48 receives a top edge 50 of the door hinge 18 having the leg 44 of each of the grips 42 resting on the top edge 50.

A pair of pads 52 is provided and each of the pads 52 is coupled to a respective one of the wings 14. Each of the pads 52 abuts a respective half 16 of the door hinge 18 when the stop 12 is positioned on the door hinge 18. Each of the pads 52 has a primary surface 54 and a secondary surface 56, and the primary surface 54 of each of the pads 52 is bonded to the second surface 22 corresponding to a respective one of the outward portions 36 of the stop 12. In this way the secondary surface 56 of each of the pads 52 abuts the respective half 16 of the door hinge 18. Furthermore, each of the pads 52 is comprised of compressible material, including but not being limited to, felt, cotton, wool or other similar type of material to inhibit the respective half 16 of the door hinge 18 from is marred by the stop 12.

In use, the door 19 is opened and the stop 12 is positioned on a respective door hinge 18 on the door 19 such that each of the grips 42 rests on the top edge 50 of the door hinge 18. In this way the stop 12 retains the door hinge 18 in the open position. Thus, the door 19 is retained in an open position without the need to use a rubber door stop or other type of door stop. In this way a door in an older house with uneven floors, for example, can be retained in the open position. Additionally, an elderly person or other person with limited mobility can more easily install the stop 12 as compared to other traditional types of door stops.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hinge stop assembly for positioning on a hinge of a door to retain the door in an open position, said assembly comprising:

a stop comprising a pair of wings being oriented at an angle with each other wherein each of said wings is configured to abut a respective half of a door hinge for retaining the door hinge in an opened position;

a pair of grips, each of said grips being coupled to and extending away from said stop wherein each of said grips is configured to engage a respective half of the door hinge for retaining said stop on the door hinge;

a pair of pads, each of said pads being coupled to a respective one of said wings wherein each of said pads is configured to abut a respective half of the door hinge when said stop is positioned on the door hinge;

wherein said stop has a first surface, a second surface and a perimeter edge extending between said first surface and said second surface, said perimeter edge having a top side, a bottom side, a first lateral side and a second lateral side;

wherein said stop has a central portion extending between a pair of outward portions;

wherein said first surface corresponding to each of said outward portions being oriented to lie on a plane forming an obtuse angle with respect to said first surface corresponding to said central portion such that each of said outward portions defines a respective one of said wings; and wherein said obtuse angle formed between said outward portions and said central portion being equivalent with each other such that said first surface corresponding to each of said outward portions forms a right angle with respect to each other wherein said second surface corresponding to each of said outward portions is configured to abut a respective half of the door hinge for retaining the door hinge in the open position; and wherein each of said grips comprises a leg and a foot, said leg of each of said grips extending away from said second surface corresponding to a respective one of said outward portions of said stop, said leg of each of said grips being positioned adjacent to said top side of said perimeter edge of said stop, said kg of each of said grips being positioned on said respective one of said outward portions adjacent to said central portion of said stop.

2. The assembly according to claim 1, further comprising a gusset having a first edge being coupled to said first surface of said stop, said gusset extending along each of said outward portions and said central portion of said stop, said gusset being centrally positioned between said top side and said bottom side of said perimeter edge of said stop, said gusset extending between said first lateral side and said second lateral side of said perimeter edge of said stop.

3. The assembly according to claim 1, wherein said foot of each of said grips is spaced from and extends downwardly along said second surface corresponding to said respective outward portion to define a hinge space between said foot of each of grips and said second surface corresponding to said respective outward portion wherein said hinge space is configured to receive a top edge of the door hinge having said leg of each of said grips resting on the top edge.

4. The assembly according to claim 1, wherein each of said pads has a primary surface and a secondary surface, said primary surface of each of said pads being bonded to said second surface corresponding to a respective one of said outward portions of said stop wherein said secondary surface of each of said pads is configured to abut the respective half of the door hinge, each of said pads being comprised of compressible material wherein each of said pads is configured to inhibit the respective half of the door hinge from being marred by said stop.

5. A hinge stop assembly for positioning on a hinge of a door to retain the door in an open position, said assembly comprising:

a stop comprising a pair of wings being oriented at an angle with each other wherein each of said wings is configured to abut a respective half of a door hinge for retaining the door hinge in an opened position, said stop having a first surface, a second surface and a perimeter edge extending between said first surface and said second surface, said perimeter edge having a top side, a bottom side, a first lateral side and a second lateral side, said stop having a central portion extending between a pair of outward portions, said first surface corresponding to each of said outward portions being oriented to lie on a plane forming an obtuse angle with respect to said first surface corresponding to said central portion such that each of said outward portions defines a respective one of said wings, said obtuse angle formed between said outward portions and said central portion being equivalent with each other such that said first surface corresponding to each of said outward portions forms a right angle with respect to each other wherein said second surface corresponding to each of said outward portions is configured to abut a respective half of the door hinge for retaining the door hinge in the open position;

a gusset having a first edge being coupled to said first surface of said stop, said gusset extending along each of said outward portions and said central portion of said stop, said gusset being centrally positioned between said top side and said bottom side of said perimeter edge of said stop, said gusset extending between said first lateral side and said second lateral side of said perimeter edge of said stop; and a pair of grips, each of said grips being coupled to and extending away from said stop wherein each of said grips is configured to engage a respective half of the door hinge for retaining said stop on the door hinge, each of said grips comprising a leg and a foot, said leg of each of said grips extending away from said second surface corresponding to a respective one of said outward portions of said stop, said leg of each of said grips being positioned adjacent to said top side of said perimeter edge of said stop, said leg of each of said grips being positioned on said respective one of said outward portions adjacent to said central portion of said stop, said foot of each of said grips being spaced from and extending downwardly along said second surface corresponding to said respective outward portion to define a hinge space between said foot of each of grips and said second surface corresponding to said respective outward portion wherein said hinge space is configured to receive a top edge of the door hinge having said leg of each of said grips resting on the top edge; and a pair of pads, each of said pads being coupled to a respective one of said wings wherein each of said pads is configured to abut a respective half of the door hinge when said stop is positioned on the door hinge, each of said pads having a primary surface and a secondary surface, said primary surface of each of said pads being bonded to said second surface corresponding to a respective one of said outward portions of said stop wherein said secondary surface of each of said pads is configured to abut the respective half of the door hinge, each of said pads being comprised of compressible material wherein each of said pads is configured to inhibit the respective half of the door hinge from being marred by said stop.

6. A hinge stop system for positioning on a hinge of a door to retain the door in an open position, said system comprising:

a door including a door hinge;

a stop comprising a pair of wings being oriented at an angle with each other such that each of said wings abuts a respective half of said door hinge for retaining said door hinge in an opened position, said stop having a first surface, a second surface and a perimeter edge extending between said first surface and said second surface, said perimeter edge having a top side, a bottom side, a first lateral side and a second lateral side, said stop having a central portion extending between a pair of outward portions, said first surface corresponding to each of said outward portions being oriented to lie on a plane forming an obtuse angle with respect to said first surface corresponding to said central portion such that each of said outward portions defines a respective one of said wings, said obtuse angle formed between said outward portions and said central portion being equivalent with each other such that said first surface corresponding to each of said outward portions forms a right angle with respect to each other wherein said second surface corresponding to each of said outward portions is configured to abut a respective half of the door hinge for retaining the door hinge in the open position;

a gusset having a first edge being coupled to said first surface of said stop, said gusset extending along each of said outward portions and said central portion of said stop, said gusset being centrally positioned between said top side and said bottom side of said perimeter edge of said stop, said gusset extending between said first lateral side and said second lateral side of said perimeter edge of said stop; and a pair of grips, each of said grips being coupled to and extending away from said stop, each of said grips engaging a respective half of said door hinge for retaining said stop on said door hinge, each of said grips comprising a leg and a foot, said leg of each of said grips extending away from said second surface corresponding to a respective one of said outward portions of said stop, said leg of each of said grips being positioned adjacent to said top side of said perimeter edge of said stop, said leg of each of said grips being positioned on said respective one of said outward portions adjacent to said central portion of said stop, said foot of each of said grips being spaced from and extending downwardly along said second surface corresponding to said respective outward portion to define a hinge space between said foot of each of grips and said second surface corresponding to said respective outward portion, said hinge space receiving a top edge of said door hinge having said leg of each of said grips resting on said top edge; and a pair of pads, each of said pads being coupled to a respective one of said wings, each of said pads abutting a respective half of said door hinge when said stop is positioned on said door hinge, each of said pads having a primary surface and a secondary surface, said primary surface of each of said pads being bonded to said second surface corresponding to a respective one of said outward portions of said stop such that said secondary surface of each of said pads abuts said respective half of said door hinge, each of said pads being comprised of compressible material to inhibit said respective half of said door hinge from being marred by said stop.

* * * * *